US008906467B2

(12) United States Patent
Marty et al.

(10) Patent No.: US 8,906,467 B2
(45) Date of Patent: Dec. 9, 2014

(54) ELECTROSTATIC SPRAY APPARATUS AND METHOD

(75) Inventors: Brian L. Marty, Minneapolis, MN (US); Heidi M. Turner, Minneapolis, MN (US); Larry L. Herfindal, Minneapolis, MN (US); Andrea J. Edwards, Minneapolis, MN (US)

(73) Assignee: Valspar Sourcing, Inc., Minneapolis, MN (US)

( * ) Notice: Subject to any disclaimer, the term of this patent is extended or adjusted under 35 U.S.C. 154(b) by 0 days.

(21) Appl. No.: 13/811,358

(22) PCT Filed: Jul. 21, 2011

(86) PCT No.: PCT/US2011/044827

§ 371 (c)(1),
(2), (4) Date: Jan. 21, 2013

(87) PCT Pub. No.: WO2012/012621

PCT Pub. Date: Jan. 26, 2012

(65) Prior Publication Data

US 2013/0122212 A1 May 16, 2013

Related U.S. Application Data

(60) Provisional application No. 61/366,277, filed on Jul. 21, 2010.

(51) Int. Cl.

| | |
|---|---|
| ***B05B 5/04*** | (2006.01) |
| ***B05C 5/02*** | (2006.01) |
| ***B05D 1/00*** | (2006.01) |
| ***B05B 5/16*** | (2006.01) |
| ***B05B 12/14*** | (2006.01) |
| ***B05B 15/02*** | (2006.01) |

(52) U.S. Cl.
CPC ..... *B05D 1/007* (2013.01); *B05B 5/1608* (2013.01); *B05B 12/14* (2013.01); *B05B 15/025* (2013.01); *B05B 5/04* (2013.01)
USPC ..... 427/484; 427/483; 118/620; 118/621

(58) Field of Classification Search
CPC ..... B05B 12/14; B05B 15/025; B05B 5/04; B05B 5/1608; B05D 1/007
USPC ..... 427/484
See application file for complete search history.

(56) References Cited

U.S. PATENT DOCUMENTS 4,232,055 A 11/1980 Shaffer
4,785,760 A 11/1988 Tholome (Continued)

FOREIGN PATENT DOCUMENTS

JP 57-24672 2/1982
WO WO 2006113201 A2 * 10/2006

OTHER PUBLICATIONS

Kremlin Rexson & Sames, "CYCLOMIX™ Multi" Data Sheets, 2 pages (downloaded from the Internet Jun. 21, 2011).

(Continued)

*Primary Examiner* — Dah-Wei D Yuan
*Assistant Examiner* — Kristen A Dagenais
(74) *Attorney, Agent, or Firm* — IPLM Group, P.A.

(57) ABSTRACT

Target substrates are electrostatically coated by flowing an electrically isolated wet coating composition containing waterborne coalescable polymeric binder into an electrostatic coating apparatus (100), depositing the coating composition onto a rotating electrostatically-charged atomizer (104) and then onto the target substrate, flowing an electrically isolated aqueous cleaning liquid into the apparatus before deposition of the coating composition onto the rotating atomizer is halted or interrupted, and depositing the aqueous cleaning liquid onto the atomizer before or within a sufficiently short time after a halt or interruption in coating composition deposition onto the atomizer so that a coalesced polymeric binder film does not accumulate on the atomizer.

20 Claims, 4 Drawing Sheets

(56) References Cited

U.S. PATENT DOCUMENTS

| | | | | | |
|---|---|---|---|---|---|
| 4,881,563 | A | * | 11/1989 | Christian | 134/166 C |
| 4,932,589 | A | | 6/1990 | Diana | |
| 5,288,029 | A | | 2/1994 | Ishibashi et al. | |
| 5,288,525 | A | * | 2/1994 | Diana | 427/475 |
| 5,378,505 | A | | 1/1995 | Kubota et al. | |
| 5,549,755 | A | | 8/1996 | Milovich et al. | |
| 5,701,922 | A | * | 12/1997 | Knipe et al. | 134/100.1 |
| 5,753,315 | A | | 5/1998 | Minoura et al. | |
| 5,759,277 | A | | 6/1998 | Milovich et al. | |
| 5,787,928 | A | | 8/1998 | Allen et al. | |
| 5,851,292 | A | | 12/1998 | Minoura et al. | |
| 5,944,045 | A | * | 8/1999 | Allen et al. | 137/240 |
| 5,993,913 | A | | 11/1999 | Rosenberger et al. | |
| 6,341,734 | B1 | | 1/2002 | Van Der Steur | |
| 6,422,491 | B1 | | 7/2002 | Bilz et al. | |
| 6,896,010 | B2 | | 5/2005 | Cebola et al. | |
| 7,056,387 | B2 | | 6/2006 | van der Steur | |
| 2006/0241230 | A1 | * | 10/2006 | Porzio et al. | 524/425 |
| 2009/0108109 | A1 | * | 4/2009 | Mori et al. | 239/694 |
| 2012/0006916 | A1 | * | 1/2012 | Nolte et al. | 239/690 |

OTHER PUBLICATIONS

ITW Ransburg Electrostatic Systems, "Aerobell 33™ Rotary Atomizer" Service Manual, 60 pages (Mar. 2005).

ITW Ransburg Electrostatic Systems, "Aerobell 33R™ Rotary Atomizer" Service Instruction, 52 pages (2004).

ITW Ransburg, "Aerobell™" Service Manual, 92 pages (Oct. 2008).

ITW Ransburg Electrostatic Systems, "AquaBlock™ Electrostatic Waterborne Finishing System" Brochure, 2 pages (2004).

ITW Ransburg, "Evolver 303™ Dual Purge, Solventborne Robotic Atomizers" Service Manual, 86 pages (Oct. 2008).

ITW Ransburg, "MMA-303 Direct/Indirect Charge Robot and Machine Mounted Rotary Atomizer" Service Manual, 126 pages (Mar. 2010).

ITW Ransburg Electrostatic Systems, "Turbodisk 2 Assembly" Service Manual, Models: 78715, 82 pages (Jan. 2003).

ITW Ransburg, Turbodisk™ Applicator Assembly Service Manual, Model: A11376, 78 pages (Nov. 2007).

* cited by examiner

ELECTROSTATIC SPRAY APPARATUS AND METHOD

CROSS REFERENCE TO RELATED APPLICATION

This application is a national stage filing under 35 U.S.C. §371 of International Application No. PCT/US2011/044827 filed Jul. 21, 2011, which claims priority under 35 U.S.C. §119 to U.S. Provisional Application No. 61/366,277 filed Jul. 21, 2010, the disclosures of both of which are incorporated herein by reference.

FIELD

This invention relates to the application of waterborne coatings.

BACKGROUND

In an effort to reduce solvent emissions including greenhouse gases, many industrial coating processes now employ waterborne paints and other waterborne coating systems containing greatly reduced amounts of Hazardous Air Pollutant (HAP) solvents and other Volatile Organic Compounds (VOCs). These coating systems are sometimes applied using a rotary electrostatic atomizer which flows the coating system material onto an electrostatically-charged rotating (viz., spinning) disk or bell, and slings droplets of the thus-charged coating material toward a grounded conductive substrate. A frequent concern in such systems is the need to maintain electrical isolation between the electrostatically-charged rotary atomizer and the coating system material supply. Electrical isolation may be provided or aided by routing the coating system material through a transfer block having a piston and a pair of electrically isolated supply cylinders, or by routing the material through a pair of electrically isolated reservoirs. In operation, metered amounts of the coating system material are alternately supplied to the atomizer from a transfer block supply cylinder or from a reservoir while the other supply cylinder or reservoir is being refilled.

Many industrial coating processes require frequent material changes, for example to change colors in otherwise similar coating materials, or to change coating materials such as changing from a primer to a topcoat. To carry out such material changes in electrostatic coating equipment, the transfer block or reservoirs in the coating equipment may be flushed with water or an organic solvent and dried with compressed air. The flushing step removes unused coating material from the transfer block or reservoir, and the drying step establishes a "voltage block" that discourages loss of electrical charge into the water or solvent supply line.

Cleaning lines are sometimes also connected directly to a rotary electrostatic atomizer. The rotary atomizer manufacturer may recommend that a nonpolar, nonflammable solvent (e.g., amyl acetate, methyl amyl acetate, mineral spirits, high flash naphtha, toluene or xylene) be used for cleaning, and that conductive solvents (e.g., acetone, diacetone, butyl alcohol, Butyl Cellosolve, methanol or monoethyl ether of diethylene glycol) not be employed. The atomizer manufacturer may also recommend that if a polar solvent is employed for cleaning, that doing so be followed by cleaning with a nonpolar solvent to remove conductive residue on the atomizer's surface.

The organic solvents used to clean rotary electrostatic atomizers may pose environmental or other hazards, may represent a waste disposal problem, and often are expensive.

Rotary electrostatic atomizer manufacturers warn against using excessive amounts of such solvents, as the solvent may penetrate past the seals typically used to protect the air bearings and air turbines used in typical rotary electrostatic atomizers and may damage or contaminate these delicate parts.

SUMMARY OF THE INVENTION

When used with waterborne polymeric binders, rotary electrostatic atomizers can easily become clogged or otherwise fouled if a coalesced polymeric film forms on the atomizer. This can be a particularly severe problem if an attempt is made to apply a latex paint or other emulsion polymer coating system, or a multiple-component (e.g., two-component) coating system employing a reactive, crosslinkable or polymerizable binder. Under the high speed, high turbulence conditions present at the surface of the spinning disk or bell in a typical rotary electrostatic atomizer, an even momentary interruption in the flow of an emulsion polymer onto the disk or bell can cause emulsion polymer already on the disk or bell to dry nearly instantaneously and form a very difficult to remove hardened film. The film may form a mere fraction of a second after the emulsion polymer flow ceases. Film removal may require disassembly of the rotary atomizer and tedious manual cleaning of the disk or bell.

The assignee of the present invention recently developed a two-part aqueous coating system whose first part comprises a waterborne active hydrogen-functional latex binder and whose second part comprises a water-dispersible polyisocyanate, wherein one or both of the first and second parts comprise non-infrared-absorptive colored pigment, and wherein a mixture of the first and second parts coated atop a vinyl substrate will cure to form a vinyl-adherent, infrared-reflective colored protective film. Further details regarding this coating system may be found in U.S. Provisional Application No. 61/360,804 filed Jul. 1, 2010, the disclosure of which is incorporated herein by reference. This coating system forms an even more durable dried coating than the coatings formed by conventional one-part lattices and thus is even harder to remove. The two-part coating system also has a reduced VOC level compared to many conventional one-part waterborne lattices. High VOC levels help wash away or redisperse partially-coalesced latex films when additional latex coating composition is applied to a partially-dried coated substrate. When attempts were made to apply the two-part coating system onto substrates using commercially available rotary electrostatic atomizers, significant amounts of dried coating film accumulated on the rotary atomizers during use. An even thicker dried film was formed if the atomizers were halted to carry out adjustments, to load new substrate parts for coating, or to undertake a color or material change. The resulting coating material buildup adversely impacted atomizer spray patterns, and sometimes caused the accidental deposit of small hardened coating material chunks onto substrate parts during coating. Suppliers of the rotary electrostatic atomizer equipment were unable to solve these problems, and cleaning the fouled disks and bells was very difficult owing to the tenacious bond formed by the cured two-part latex film.

Applicants addressed the above-mentioned problems by modifying commercially available rotary electrostatic atomizer equipment. Their invention provides, in one aspect, a method for electrostatically coating a target substrate, which method comprises:

a) flowing an electrically isolated wet coating composition comprising a waterborne coalescable polymeric binder through a first fluid conduit in controlled fluid communication with and into an electrostatic coating apparatus comprising an electrostatically-charged rotating atomizer;

b) depositing sufficient coating composition onto the rotating atomizer so that electrostatically-charged coating composition droplets are slung onto the target substrate and form a coating thereon;

c) flowing an electrically isolated aqueous cleaning liquid through a second fluid conduit in controlled fluid communication with and into the apparatus before deposition of the coating composition onto the rotating atomizer is halted or interrupted; and d) depositing the aqueous cleaning liquid onto the atomizer before or within a sufficiently short time after a halt or interruption in coating composition deposition onto the atomizer so that a coalesced polymeric binder film does not accumulate on the atomizer.

The invention provides, in another aspect, an electrostatic coating apparatus comprising a rotatable, electrostatically-chargeable atomizer and a fluid flow control unit, wherein:

a) the apparatus is in fluid communication with a first fluid conduit that controllably supplies the apparatus with an electrically isolated wet coating composition comprising a waterborne coalescable polymeric binder and in fluid communication with a second fluid conduit that controllably supplies the apparatus with electrically isolated aqueous cleaning liquid; and b) the fluid flow control unit is operatively coupled and configured to:

i) controllably deposit the wet coating composition onto the atomizer while the atomizer rotates and is electrostatically charged, ii) controllably flow the electrically isolated aqueous cleaning liquid through a second fluid conduit and into the apparatus before deposition of the coating composition onto the atomizer is halted or interrupted, and is further operatively coupled and configured to controllably deposit the aqueous cleaning liquid onto the atomizer before or within a sufficiently short time after a halt or interruption in coating composition deposition onto the atomizer so that a coalesced polymeric binder film does not accumulate on the atomizer.

The disclosed method and apparatus have particular utility when used with waterborne emulsion polymer binders. In one preferred embodiment, the disclosed method and apparatus facilitate operation of a coalescable polymeric binder coating line by reducing fouling of the electrostatic coating apparatus when the line is halted or interrupted or when a coating material or color changeover is performed. In another preferred embodiment, the method and apparatus permit water rather than a coating composition to be discharged during the interval between departure of a freshly-coated target substrate and the arrival of a new uncoated target substrate, without causing fouling of the apparatus. Preferred embodiments of the method and apparatus also reduce solvent usage, coating composition waste or cleanup time.

BRIEF DESCRIPTION OF THE DRAWING

Like reference symbols in the various figures of the drawing indicate like elements. The elements in the drawing are not to scale.

DETAILED DESCRIPTION

Figure 1:
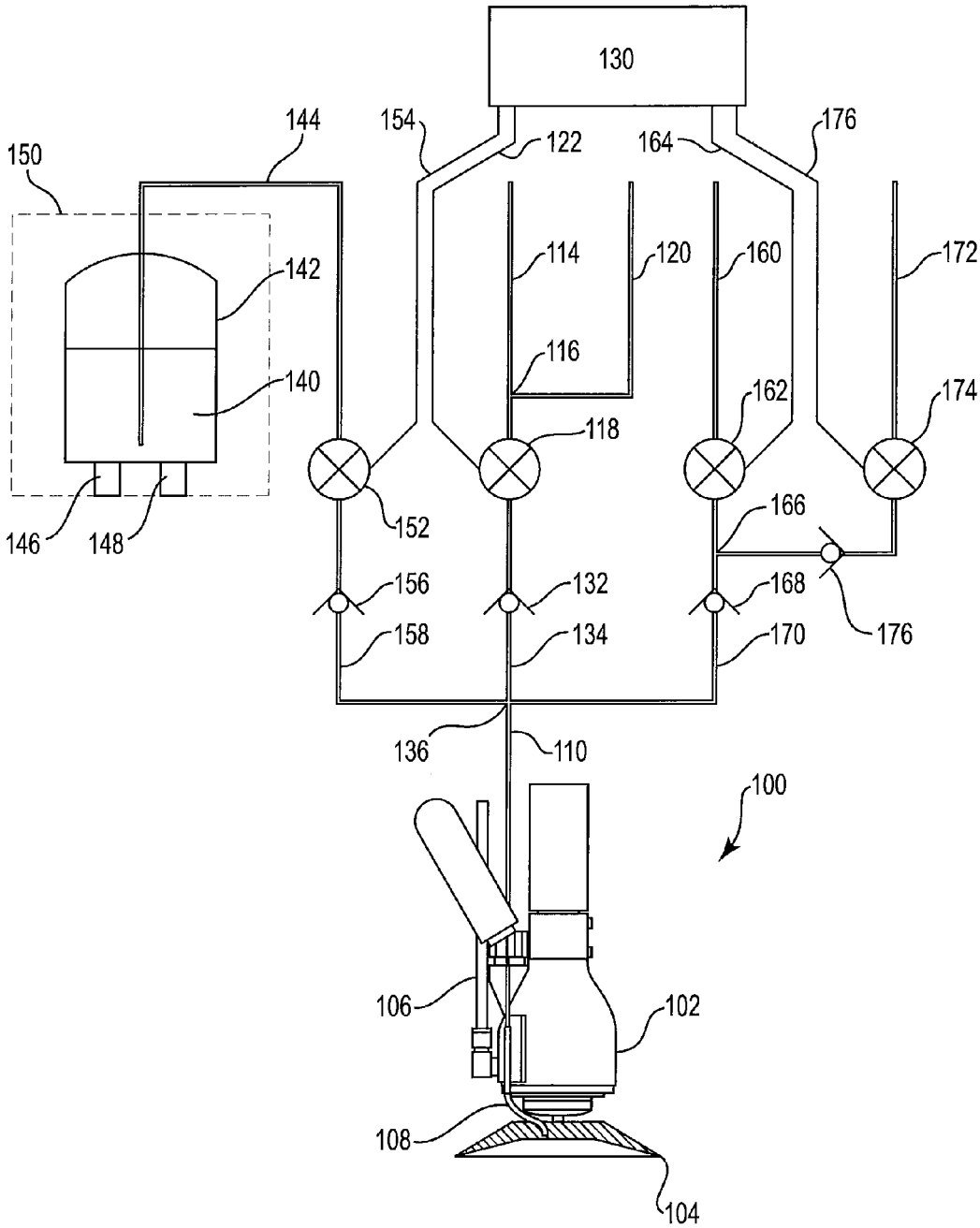
FIG. 1 is a schematic view, partially in cross-section, of an electrostatic turbodisk applicator of the invention.

The recitation of a numerical range using endpoints includes all numbers subsumed within that range (e.g., 1 to 5 includes 1, 1.5, 2, 2.75, 3, 3.80, 4, 5, etc.).

The terms "a," "an," "the," "at least one," and "one or more" are used interchangeably. Thus, for example, an apparatus that contains "a" control unit means that the apparatus includes "one or more" control units.

The term "accumulate" when used with respect to a film at least partially covering a rotary atomizer surface means to increase in thickness or extent of coverage during atomizer operation or when atomizer operation is halted or interrupted.

The term "coalesced" when used with respect to a film at least partially covering a surface means to form a solid, substantially continuous deposit that cannot be manually wiped away using at least one firmly-applied swipe of water-dampened cheesecloth.

The terms "controlled" and "controllably" when used with respect to the supply, deposition or flow of a liquid from, to, into, through or onto a supply tank, conduit, valve, apparatus or other liquid-handling element mean to effect initiation, cessation, increase or decrease in the volume of liquid handled by such element.

The term "electrically isolated" when used with respect to a component or material in an electrostatic coating apparatus means that the presence of the component or material in the apparatus does not reduce electrostatic charge on the electrostatic atomizer in such apparatus, or that the observable charge reduction is sufficiently small that target substrates may still be adequately coated using the electrostatic coating apparatus. Such electrical isolation may for example be provided by insulating the component or material from ground, or by maintaining the component or material at a sufficiently high potential with respect to that of the electrostatic atomizer. In addition, such electrical isolation need not (and in preferred embodiments does not) involve electrically isolating the component or material from the atomizer.

The term "fluid communication" means that fluid flows or will flow between specified endpoints or along a specified path.

The term "fouling" when used with respect to an electrostatic coating applicator or rotary electrostatic atomizer means to accumulate sufficient solid deposits on the atomizer or applicator such that disassembly and manual cleaning of the atomizer or applicator will be necessary before satisfactory coating can be resumed.

The term "low VOC" when used with respect to a liquid coating composition means that the coating composition contains less than about 10 wt. % volatile organic compounds, more preferably less than about 7% volatile organic compounds, and most preferably less than about 4% volatile organic compounds based upon the total liquid coating composition weight.

The terms "polymer" and "polymeric" include polymers as well as copolymers of two or more monomers.

The terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

The term "solvent-borne" when used in respect to a coating composition means that the major liquid vehicle or carrier for the coating composition is a nonaqueous solvent or mixture of nonaqueous solvents.

When used with respect to a component which may be found in a coating composition, the term "substantially free of" means containing less than about 1 wt. % of the component based on the composition weight.

The term "waterborne" when used in respect to a coating composition means that the major liquid vehicle or carrier for the coating composition is water.

Referring to FIG. 1, electrostatic coating applicator 100 includes air motor 102, atomizer disk 104, turbine and air bearing compressed air supply line 106 and fluid deposition nozzle 108. Fluids are supplied to applicator 100 via connecting conduit 110 from three controllable fluid sources respectively supplying wet coating composition, aqueous cleaning liquid or organic solvent. An electrically isolated wet coating composition is supplied via first conduit 114, and passes through tee 116 to flow control valve 118. Excess wet coating composition recirculates via return line 120. Valve 118 is opened and closed via signals on control lead 122 from control center 130, and when opened permits the flow of wet coating composition through check valve 132, connecting conduit 134, four-way junction 136, connecting conduit 110 and nozzle 118 for deposit on atomizer 104.

An aqueous cleaning liquid 140 is supplied from pressure pot 142 via second conduit 144. Electrical isolation of aqueous cleaning liquid 140 may be provided using a variety of insulation or other isolation measures that will be understood by persons having ordinary skill in the art, including supporting mounting pressure pot 142 on suitable insulated standoffs 146, 148 and by using nonconductive hoses and fittings to carry aqueous cleaning liquid 140 from pot 142 to applicator 100. Cage 150 helps prevent arcing or other discharge from pot 142 and prevents contact with nearby personnel. The supply of aqueous cleaning liquid could be electrically isolated by other methods including the use of transfer block or reservoir systems like those employed to provide electrical isolation of wet coating compositions in a conventional electrostatic applicator line, but the pressure pot shown in FIG. 1 represents a simple, flexible approach that works well at minimal capital investment. Pressure pot 142 desirably is provided with a supply of compressed air in the headspace above aqueous cleaning liquid 140. Sufficient pressure is maintained in pot 142 during use so as to force aqueous cleaning liquid into conduit 110 and applicator 100 when valve 152 is opened. The electrically isolated aqueous cleaning liquid may be delivered to the applicator in a variety of other ways. For example, the aqueous cleaning liquid may instead or also be pumped. The pump requirements are modest and can be met by a variety of pump designs including diaphragm pumps, peristaltic pumps, and valveless rotating or reciprocating piston metering pumps. Particularly preferred pumps start and stop automatically when a downstream valve such as valve 152 is opened and closed, and need not operate between aqueous cleaning liquid deposition cycles. Exemplary such pumps include positive displacement diaphragm pumps having built-in pressure switches that automatically start and stop pumping when the downstream valve is opened, such as the FLOWJETT™ 2100 pump available from the Flowjet Division of ITT Industries. Other exemplary pumps that start and stop automatically include positive displacement reciprocating double diaphragm pumps such as the WILDEN™ PI plastic pump available from Wilden Pump & Engineering, LLC and pneumatic single diaphragm pumps such as the YAMADA™ NDP-5 pump available from Yamada America. Pumps which do not automatically start and stop upon action of a downstream valve may also be used, for example by employing a control unit that actuates both the pump and the downstream discharge valve when the flow of aqueous cleaning liquid is desired.

Pot 142 desirably is sufficiently large and desirably contains sufficient aqueous cleaning liquid 140 to accommodate an expected or potential number of halts or interruptions in the deposition of wet coating composition onto atomizer 104 during at least one shift, at least one day, at least one color run, or at least one run of coated substrate parts. The flow of aqueous cleaning liquid 140 to applicator 100 is controlled by flow control valve 152, signals on control lead 154 and control center 130. When opened, valve 152 permits the flow of aqueous cleaning liquid through check valve 156, connecting conduit 158, four-way junction 136, connecting conduit 110 and nozzle 118 for deposit on atomizer 104.

An organic solvent may optionally be used, for example, to carry out additional cleaning of applicator 100 at the end of a shift or at other desired times. If used, organic solvent may be supplied via third conduit 160. The flow of organic solvent to applicator 100 is controlled by flow control valve 162, signals on control lead 164 and control center 130. When opened, valve 162 permits the flow of organic solvent through tee 166, check valve 168, connecting conduit 170, four-way junction 136, connecting conduit 110 and nozzle 118 for deposit on atomizer 104. Compressed air may optionally be supplied from fourth conduit 172. The flow of compressed air to applicator 100 is controlled by flow control valve 174, signals on control lead 176 and control center 130. When opened, valve 174 permits the flow of compressed air through tee 166, check valve 168, connecting conduit 170, four-way junction 136, connecting conduit 110 and nozzle 118, thereby removing residual solvent between at least tee 166 and junction 136, removing solvent or other materials from conduit 110 and nozzle 118, and establishing a voltage block in the solvent supply line to prevent or limit loss of electrostatic charge into the solvent supply source.

The timing and operation of the various valves operated by control unit 130 desirably is such as to maintain a standing column of aqueous cleaning liquid 140 between pot 142 and junction 136, so that prior to or upon any halt or interruption of the deposition of wet coating composition onto atomizer 104, valve 152 may be opened and aqueous cleaning liquid 140 may immediately begin flowing into conduit 110 and nozzle 108. Doing so may be facilitated by using pneumatically actuated control valves to control some or all of the respective fluid flows.

Figure 2:
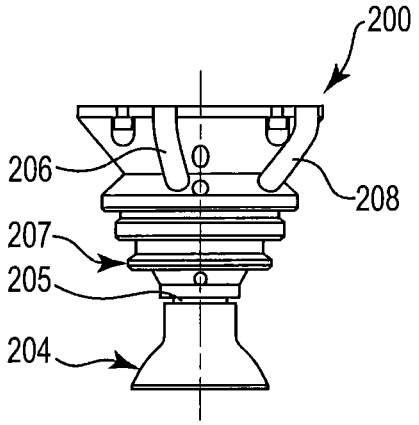
FIG. 2 is a side view of an electrostatic turbobell applicator of the invention.
Figure 3:
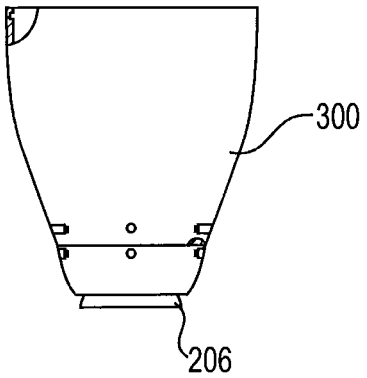
FIG. 3 is a side view of the FIG. 2 apparatus including an outer fairing.

FIG. 2 shows an end portion of an electrostatic turbobell applicator 200 including atomizing bell 204, mounting shaft 205, air bearing compressed air supply line 206, air bearing 207 and liquid supply line 208. FIG. 3 shows a fairing 300 for the end of applicator 200. Applicator 200 may be supplied with an electrically isolated supply of aqueous cleaning liquid as described above for FIG. 1, with the primary distinction being that the thus-modified applicator will employ a rotating bell rather than a rotating disk to atomize the wet coating composition.

Figure 4:
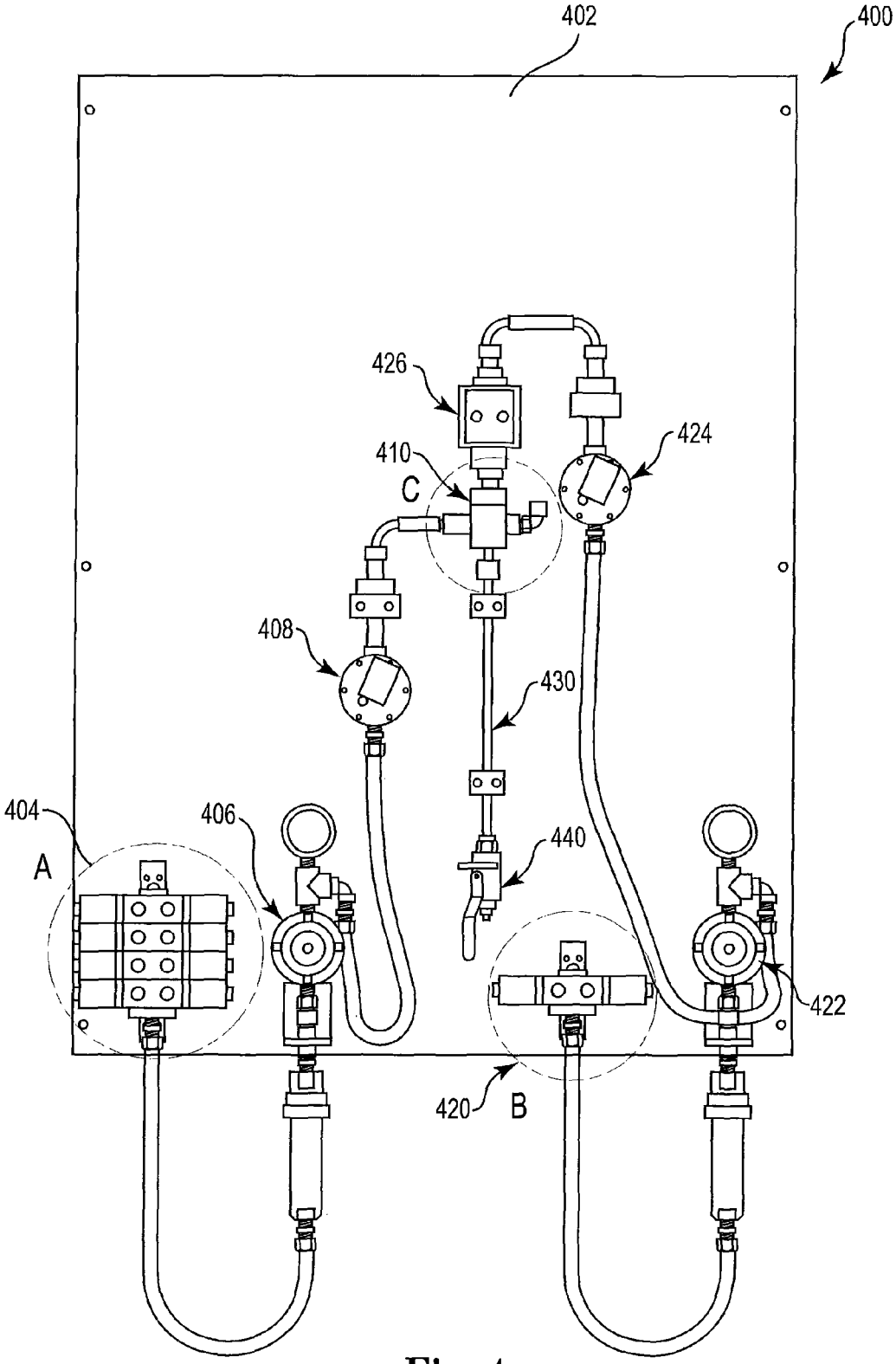
FIG. 4 is a side view of a color changer and mixing block system for supplying a two-part coating composition to an apparatus of the invention.
Figure 5:
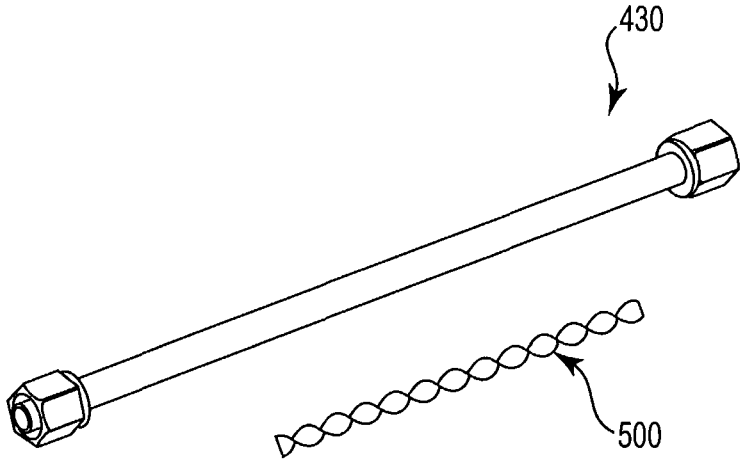
FIG. 5 is a perspective view of a static mixer and mix tube for use in the FIG. 4 system.

FIG. 4 shows a supply circuit 400 for supplying a two-part wet coating composition to a rotary atomizer. Mounting panel 402 provides a support for color changer 404, regulator 406 and flow meter 408 through which flow a supply of part A of a two-part coating composition in a variety of colors selected using color changer 404. At injection block 410, a metered supply of Part B of the coating composition is added to Part A. Part B flows through color changer 420, regulator 422, flow meter 424 and injector valve 426. Mixing of Part A and Part B takes place in a mixing device such as mix tube 440 which may employ a helical static mixer 500 shown in more detail in FIG. 5. The mixed coating composition exiting mix tube 430 may be supplied to an electrostatic coating applicator made in accordance with the present invention via a supply line such as first fluid inlet 160 in FIG. 1.

Figure 6:
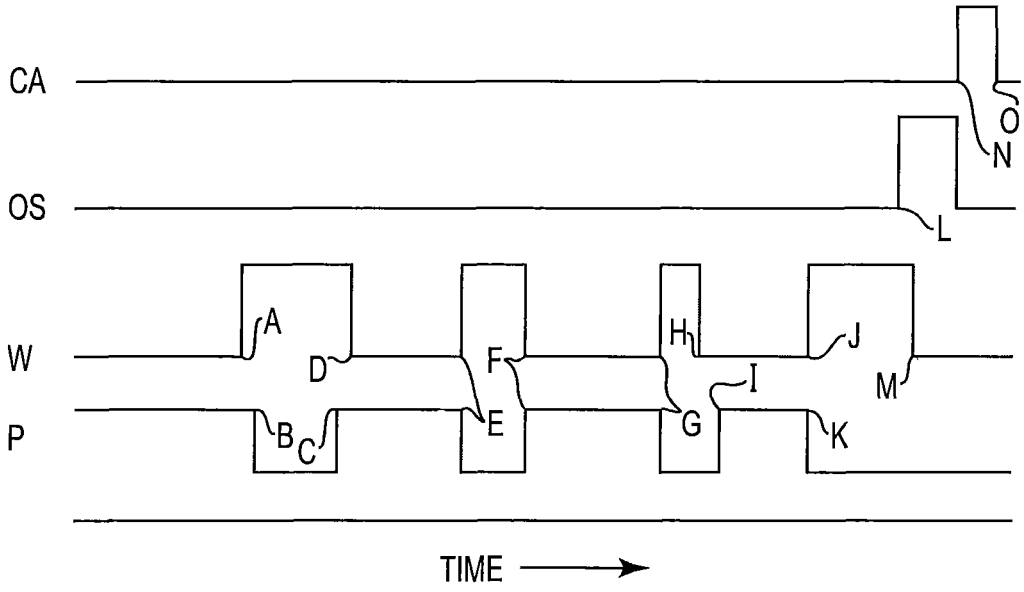
FIG. 6 is a timing diagram for use in the invention.

FIG. 6 shows an exemplary timing diagram illustrating some of the many modes of operation that may be used in the disclosed apparatus and method. Time is represented by the horizontal axis, and material flow is represented by four high-order (flow on) or low order (flow off) traces stacked above one another along the vertical axis. The traces show exemplary timings for paint (P, the wet coating composition), water (W, the aqueous cleaning liquid), organic solvent (OS) and compressed air (CA). The high order and low order designations refer to the presence or absence of flow at the respective control valves, it being understood that deposition of the corresponding material on the atomizer may not occur until a very short time later when the flow is able to reach the atomizer. Events occurring along the timing diagram are labeled with the letters A through O, with higher letters denoting later occurrence in time. At the start of FIG. 6, paint alone flows to the disclosed applicator for deposition upon the rotating atomizer, as indicated by the high order position of trace P and the low order position of traces W, OS and CA. Shortly before interrupting the deposition of paint onto the atomizer (e.g., a few milliseconds before such interruption), the flow of water to the atomizer starts as indicated by the high order position of trace W at time A. Shortly thereafter the flow of and consequent deposition of paint onto the atomizer can be stopped, as indicated by the low order position of Trace P at time B. Meanwhile, the flowing water cleans the atomizer and maintains it in a wet state until deposition of paint upon the atomizer resumes due to the restart of paint flow, indicated by the high order position of trace P at time C. Shortly thereafter deposition of water on the atomizer can stop, as indicated by the low order position of Trace W at time D, until the next halt or interruption in paint deposition on the atomizer.

The flow of wet coating composition and aqueous cleaning liquid can start, stop or both start and stop at the same times. The first of these three situations is illustrated by a change in trace P from a high order to a low order and a change in trace W from a low order to a high order, both occurring at time E. The second situation is illustrated by a change in trace P from a low order to a high order and a change in trace W from a high order to a low order, both occurring at time F. The third situation is illustrated by traces P and W taken together at times E and F.

Although it is desirable that the atomizer has deposited thereon wet coating composition or aqueous cleaning liquid whenever the atomizer is rotating, doing so is not required. Traces P and W at times G, H and I illustrate an operating mode in which the atomizer has deposited thereon wet coating composition followed by aqueous cleaning liquid until the atomizer surface has been cleaned sufficiently so that a coalesced polymeric binder film will not accumulate on the atomizer.

In principle, it may be possible to time the flow of aqueous coating liquid so that there is a small time interval, however brief, between the cessation of wet coating composition deposition on the atomizer and the arrival or the aqueous coating composition. Doing so with binders based on emulsion polymers will however require very careful timing owing to the near-immediate formation of a coalesced emulsion polymer film on the atomizer following a halt or interruption in coating composition deposition. It is preferable to use timing that guarantees the arrival of aqueous cleaning liquid on the atomizer prior to any halt or interruption in wet coating composition deposition.

For the flow timings discussed thus far in FIG. 6, only conductive fluids are sent to the electrostatic coating applicator while the atomizer is rotating. Traces P, W, OS and CA illustrate a further operating mode in which the flow of water starts at time J, followed shortly thereafter by a halt in paint flow at time K. Shortly before the end of the water rinse (which continues until time M), the flow of organic solvent is started as indicated by the change in trace OS from a low order to a high order at time L. At time N the organic solvent flow halts and is replaced by compressed air which dries the atomizer and reestablishes a voltage block in the organic solvent supply line near the applicator. The flow of compressed air stops at time O. When the organic solvent is nonpolar, this operating mode sequentially supplies conductive fluids (viz., wet coating composition and aqueous cleaning liquid) followed by nonconductive fluids (viz., nonpolar organic solvent and compressed air) to the electrostatic coating applicator while the atomizer is rotating. When using such an operating mode, care preferably is taken to avoid sending compressed air through the applicator cleaning circuits until the atomizer has been thoroughly cleaned.

Air may if desired be introduced into or left in the apparatus passages or other conduits carrying the aqueous cleaning liquid, so long as the time taken for such air to vent at the atomizer is taken into account when turning on the aqueous cleaning liquid flow. Preferably however a standing column of aqueous cleaning liquid is maintained in the apparatus passages, especially downstream from the control valve for the aqueous cleaning liquid, and not blown dry with compressed air or otherwise removed while electrostatic coating operations are underway.

In a preferred embodiment, the supply of electrically isolated aqueous cleaning liquid is introduced directly into the electrostatic coating applicator, and downstream from a color changer, transfer block, reservoir system or other point at which electrically isolated wet coating composition is made available to the electrostatic coating applicator. If desired however the aqueous cleaning liquid may be introduced upstream, e.g., at or before a color changer, transfer block or reservoir system, with the understanding that doing so will result in added coating composition waste during cleaning operations. Supplying electrically isolated aqueous cleaning liquid directly to the electrostatic coating applicator accordingly can reduce coating composition consumption and waste.

In another preferred embodiment, the flow of wet coating composition to and onto the atomizer is replaced by a flow of electrically isolated aqueous cleaning liquid (e.g., plain water) during intervals between application of a wet coating composition onto target substrates moving with respect to (e.g., past) the electrostatic coating applicator. This may for example take place during the interval between departure of a freshly-coated target substrate and the arrival of a new uncoated target substrate along a coating line, or while a robotic arm supporting the atomizer is moved from an ending position for a repetitive motion cycle to a starting position for a new such cycle. The electrostatic charge may be turned off or left on while the aqueous cleaning liquid is deposited on the atomizer, and the droplets of aqueous cleaning liquid that are slung from the atomizer may be directed away from nearby target substrates, may be directed onto a noncritical area (e.g., a substrate portion that will be hidden in a finished assembly) or may be directed into a dump box or other receptacle. This permits more economical electrostatic application of coalescable polymeric binder compositions that might otherwise foul a rotary atomizer if the flow of wet coating composition were to be switched off (e.g., in an effort to reduce waste) for even a very short time interval between coated substrate parts.

The disclosed apparatus and method desirably permit cleaning the disk at any time, and whether or not the coating composition color is being changed. The apparatus and method accordingly provide an atomizer flush rather than a full coating system flush. The apparatus and method enable halts or interruption in a coating line, including those necessitated by color or material changes, while avoiding the introduction of air into the apparatus passages. This can facilitate faster cleaning cycles, with less formation of bubbles or foam and less coating material waste.

The disclosed aqueous cleaning liquid contains water, which may be tap, deionized, distilled, reverse osmosis or recycled water. The water may be at ambient temperature or cooled below or heated above ambient temperature. Preferably most (e.g., more than 50 weight percent, more than 60 weight percent, more than 70 weight percent, more than 80 weight percent, more than 90 weight percent or more than 95 weight percent) or all of the aqueous cleaning liquid is water. However, the aqueous cleaning liquid may if desired contain a variety of other ingredients that will be appreciated by persons having ordinary skill in the art, including surfactants, detergent builders, caustics, acids, defoamers or organic solvents including water-miscible or hydrophilic solvents.

Persons having ordinary skill in the art will also appreciate that a wide variety of flow sensors, pressure sensors or other devices may be added to or substituted for the components shown in the Drawing, for example to provide additional information or control over operating conditions, such as to detect unplanned or accidental halts or interruptions in the deposition of wet coating composition onto the rotary atomizer. Persons having ordinary skill in the art will also appreciate that more, fewer or other control and piping arrangements may be employed to operate the disclosed apparatus. Reference is made to available service manuals including those provided by ITW Ransburg Electrostatic Systems for its AEROBELL™ 33, AEROBELL 33R, AEROBELL A12381, EVOLVER™ 303, MMA-303, TURBODISK™ and TURBODISK 2 rotary atomizers and to those provided by Exel North America for its CYCLOMIX™ EXPERT and CYCLOMIX MULTI electronic dosing systems for illustration of a variety of devices and a variety of control and piping arrangements that may be modified in accordance with the present invention. For example, many electrostatic applicators have organic solvent and air supply lines. For applications in which the applicator will be used only with wet coating compositions which can adequately be cleaned off the atomizer using aqueous cleaning liquid alone, the further use of an organic solvent for cleaning may be unnecessary. In such instances the existing solvent supply circuit may be modified by replacing the existing, typically grounded solvent supply source with an electrically isolated receptacle containing aqueous cleaning liquid. Additional measures may be needed including electrically isolating the remainder of the original solvent supply circuit. The resulting modified applicator may be used to deliver aqueous cleaning liquid to the atomizer via the modified solvent supply circuit.

The method and apparatus may be used to apply wet coating compositions containing waterborne coalescable polymeric binders to a variety of appropriately conductive substrates including metals and alloys, conductive plated or coated plastic substrates including thermoplastic, thermoplastic composite, thermoplastic-clad, thermoset, thermoset composite, thermoset-clad, wood, impregnated wood and wood-derived materials. Exemplary metals include aluminum, brass, copper, iron, pot metal, steel, tin and zinc. Exemplary thermoplastic polymers may for example include vinyl (PVC), polystyrene (PS), thermoplastic polyolefin (TPO) such as polyethylene (PE) and polypropylene (PP), acrylonitrile-butadiene-styrene (ABS), polycarbonate (PC), nylon, polyethylene terephthalate (PET) or other polyesters, and other thermoplastics that will be familiar to persons having ordinary skill in the art. Exemplary thermoplastic composite substrates may include any of the above-mentioned thermoplastic polymers together with reinforcing fillers, strands or woven or nonwoven webs made from materials including fiberglass (e.g., composites made by pultrusion), natural fabrics and fibers (e.g, cotton), carbon fibers and fabrics, wood fibers and various wood byproducts, and other composite reinforcing materials that will be familiar to persons having ordinary skill in the art. Exemplary thermoplastic-clad substrates may include a partial or complete shell containing one or more such thermoplastic polymers or thermoplastic composites and a solid, foamed or hollow core made of wood, metal, plastic or other material that will be familiar to persons having ordinary skill in the art. Exemplary thermoset polymers may for example be made from cyanate ester resins, epoxy resins, melamine resins, phenol-formaldehyde resins, polyimide resins, urea-formaldehyde resins and vulcanized rubbers.

The disclosed method and apparatus may be used with the two-part aqueous coating system disclosed in the above-mentioned U.S. Provisional Application No. 61/360,804 to replace solvent-borne or aqueous paint systems that may previously have been used on such substrates, e.g., the various CHEMCRAFT™ finishes from Akzo Nobel Coatings Inc., AQUASURTECH™ coatings from AquaSurTech Coating Products, N.A., FLEXACHRON™ finishing systems from PPG Industrial Coatings and POLANE SOLAR™ solar reflective polyurethane enamels from Sherwin-Williams Company.

The disclosed coated articles may be used for a variety of purposes. Representative end-use applications include transportation vehicles including cars, trucks, trains and ships; architectural elements such as windows, doors, siding, shutters, trim, moldings, jambs and other elements used on or around openings; railings; furniture; cabinetry; walls; ceilings; decking and other flooring including engineered flooring, roofing, and marine trim or other building components.

The invention is further illustrated in the following non-limiting examples, in which all parts and percentages are by weight unless otherwise indicated.

EXAMPLE 1

The Part A ingredients shown below in Table 1 were combined and mixed to provide a uniform dispersion. The Part A dispersion was then mixed with the Part B polyisocyanate to provide a black-tinted non-infrared-absorptive coating composition containing an emulsion polymer:

TABLE 1

| Ingredient | Example 1, Parts |
|---|---|
| Part A | |
| Grind: | |
| Water | 129 |
| BENTONE EW Rheology Modifier | 3 |
| CELLOSIZE QP-09-L Rheology Modifier | 2 |
| TEGO FOAMEX 810 Defoamer | 3 |
| HYDROPALAT 44 Dispersant | 7 |
| TAMOL 731 A Dispersant | 3 |
| Ammonia | 0.3 |
| EFKA 4510 Surfactant | 4 |
| T-DET N 10.5 Surfactant | 3 |
| Soy Lethicin | 3 |
| SHEPHERD ARTIC Black 30C940 Pigment | 261 |
| SYLOID 74 Flattening Pigment | 5 |
| VANSIL W 30 Flattening Pigment | 1 |
| POLYPHASE 663 Biocide | |
| KATHON LX Preservative | 1.5 |
| VORCHER LH 10 Catalyst | 8 |
| Letdown: | |
| Water | 68 |
| EPS-2771 Acrylic Emulsion | 485 |
| KYNAR AQUATEC ARC Fluoropolymer Emulsion | 40 |
| Final Ingredients: | |
| TINUVIN 292HP UV Absorber | 5 |
| TINUVIN 1130 Hindered Amine Light Stabilizer | 10 |
| DOWANOL DPM Cosolvent | 7 |
| Water | 20 |
| MICHEM Emulsion 32535 Wax | 8 |
| BYK 348 Wetting Agent | 1 |
| ACRYSOL RM-12W Rheology Modifier | 0.5 |
| ACRYSOL RM-2020 NPR Rheology Modifier | 3 |
| Part B | |
| BAYHYDUR 304 water-dispersible polyisocyanate | 43.5 |
| Non-HAPS solvents | 2.0 |

The Example 1 coating composition was applied to a variety of substrates (including vinyl, vinyl-wood composites, vinyl-clad wood, fiberglass pultrusion, reaction injection molded urethane foam, wood and engineered wood) at wet film thicknesses sufficient to provide an about 50 to about 260 μm (about 1.5 to about 10 mil) dry film thickness, and cured by air drying for 1 to five minutes depending on the film build followed by heating at 60 to 65° C. for 8 to 10 minutes. Electrostatic application was evaluated using an applicator with a 15.24 cm diameter rotary atomizer disk spinning at 10,000 RPM. A metered gear pump was used to supply wet coating composition at 400 $cm^3$/min. During the coating run, the flow from the gear pump occasionally dropped to near zero due to the unplanned buildup of emulsion polymer on the pump gears. This buildup may have been aggravated by the low VOC level of the chosen wet coating composition, since VOCs can help lubricate or clean the internal parts of such pumps. The consequent brief interruptions in coating composition flow also caused emulsion polymer buildup on the atomizer. Within an hour after the start of operation, a hardened coalesced emulsion polymer film had formed on the disk face and near its edge, a significantly thicker hardened coalesced emulsion polymer film had accumulated near the disk hub, and approximately half the deposition holes at the disk hub had become plugged.

In an additional run, the disk was cleaned to remove the hardened emulsion polymer, and the wet coating composition delivery system was modified by replacing the metered gear pump with a delivery system employing a pressure pot and a mass flow meter. The modified system ran about one hour longer than the gear pump system before noticeable emulsion polymer buildup and coating quality deterioration was observed.

In another run, the disk was again cleaned to remove the hardened emulsion polymer, and the wet coating composition delivery system was modified by replacing the pressure pot and mass flow meter with An AQUABLOCK™ electrostatic isolation system (a device employing a transfer block and four-way valve for electrically isolating the paint supply line) from ITW Ransburg Electrostatic Systems. Emulsion polymer buildup and coating quality deterioration was again observed. This appeared to be caused by interruptions in coating composition flow which took place when the four-way ISOPURGE™ valve in the AQUABLOCK system rotated between operating positions.

In yet another run, the electrostatic coating apparatus and its operation were further modified by supplying Part A of the coating composition from an electrically isolated pressure pot and mass flow meter, by supplying Part B (which was non-conductive) from a grounded second pressure pot and mass flow meter, and by supplying a plain water aqueous cleaning liquid from an electrically isolated third pressure pot. The wet coating composition flow was deliberately halted every half hour to simulate a color change, equipment adjustment, end of a run of parts, shift change or other planned interruption) while meanwhile depositing water onto the atomizer supplied from the third pressure pot and maintaining the water flow without interruption until flow of the wet coating composition was restarted. During these halts in coating composition flow, the electrostatic charge was turned off, the coating composition pressure pots were refilled and repressurized as needed and the atomizer disk was examined. After a three cycle (1.5 hour) run sequence, the atomizer exhibited no coalesced emulsion polymer film at all on the atomizer disk face and edge, and only minor hardened coalesced emulsion polymer film accumulation near the disk hub. One of the deposition holes at the disk hub had become plugged, possibly due to a piece of debris falling into the Part A or Part B pressure pots. The atomizer produced high quality electrostatically applied coatings whose appearance throughout the coating run was noticeably better than the coating appearance near the end of the coating runs performed without the electrically isolated water rinse modification. Cleaning the atomizer disk after the final run also required significantly less effort than the efforts required before the electrically isolated water rinse modification.

Having thus described the preferred embodiments of the present invention, those of skill in the art will readily appreciate that the teachings found herein may be applied to yet other embodiments within the scope of the claims hereto attached. The complete disclosure of all patents, patent documents, and publications are incorporated herein by reference as if individually incorporated.

We claim:

1. A method for electrostatically coating a target substrate, which method comprises:

a) flowing an electrically isolated wet coating composition comprising a waterborne coalescable polymeric binder through a first fluid conduit in controlled fluid communication with and into an electrostatic coating applicator comprising an electrostatically-charged rotating atomizer;

b) depositing coating composition onto the rotating atomizer so that electrostatically-charged coating composition droplets are slung onto the target substrate and form a coating thereon;

c) flowing an electrically isolated aqueous cleaning liquid through a second fluid conduit in controlled fluid communication with and into the applicator before deposition of the coating composition onto the rotating atomizer is halted or interrupted; and d) depositing the aqueous cleaning liquid onto the atomizer before or within a short time after a halt or interruption in coating composition deposition onto the atomizer so that a coalesced polymeric binder film does not accumulate on the atomizer.

2. A method according to claim 1 wherein the coating composition comprises a multiple-component coating system employing a reactive, crosslinkable or polymerizable binder.

3. A method according to claim 1 wherein the coating composition comprises an emulsion polymer.

4. A method according to claim 1 wherein the coating composition comprises a latex.

5. A method according to claim 1 wherein the coating composition contains less than 10 wt. % volatile organic compounds.

6. A method according to claim 1 wherein more than 50 weight percent of the aqueous cleaning liquid is water and the aqueous cleaning liquid further comprises a surfactant, detergent builder, caustic, acid, defoamer or organic solvent.

7. A method according to claim 1 comprising depositing above ambient temperature aqueous cleaning fluid onto the atomizer.

8. A method according to claim 1 comprising supplying the aqueous cleaning liquid to the second fluid conduit using a pressure pot.

9. A method according to claim 1 comprising depositing aqueous cleaning liquid onto the atomizer before halting or interrupting coating composition deposition onto the atomizer.

10. A method according to claim 1 comprising maintaining a standing column of aqueous cleaning liquid in the second fluid conduit during electrostatic coating, or halting or interrupting coating composition deposition without introducing air into the first and second fluid conduits.

11. A method according to claim 1 comprising depositing aqueous cleaning liquid onto the atomizer during intervals between electrostatic coating of target substrates moving with respect to the electrostatic coating applicator.

12. A method according to claim 1 comprising halting or interrupting coating composition deposition and changing the coating composition to a coating composition having a different color.

13. A method according to claim 1 comprising halting or interrupting coating composition deposition without employing organic solvent to clean the atomizer.

14. An electrostatic coating apparatus comprising a fluid flow control unit and an electrostatic coating applicator comprising a rotatable, electrostatically-chargeable atomizer, wherein:

a) the applicator is in fluid communication with a first fluid conduit that controllably supplies the applicator with an electrically isolated wet coating composition comprising a waterborne coalescable polymeric binder, and the applicator is in fluid communication with a second fluid conduit that controllably supplies the applicator with electrically isolated aqueous cleaning liquid; and b) the fluid flow control unit is operatively coupled and configured to:

i) controllably deposit the wet coating composition onto the atomizer while the atomizer rotates and is electrostatically charged, ii) controllably flow the electrically isolated aqueous cleaning liquid through the second fluid conduit and into the applicator before deposition of the coating composition onto the atomizer is halted or interrupted, and is further operatively coupled and configured to controllably deposit the cleaning liquid onto the atomizer before or within a short time after a halt or interruption in coating composition deposition onto the atomizer so that a coalesced polymeric binder film does not accumulate on the atomizer.

15. An apparatus according to claim 14 wherein the atomizer comprises a disk or bell.

16. An apparatus according to claim 14 comprising a pressure pot in fluid communication with the second fluid conduit.

17. An apparatus according to claim 14 wherein the fluid flow control unit is operatively coupled and configured to deposit aqueous cleaning liquid onto the atomizer before halting or interrupting coating composition deposition onto the atomizer, or to deposit wet coating composition or aqueous cleaning liquid onto the atomizer whenever the atomizer is rotating.

18. An apparatus according to claim 14 wherein the fluid flow control unit is operatively coupled and configured to maintain a standing column of aqueous cleaning liquid in the second fluid conduit during electrostatic coating, or to halt or interrupt coating composition deposition without introducing air into the first and second fluid conduits.

19. An apparatus according to claim 14 wherein the fluid flow control unit is operatively coupled and configured to deposit aqueous cleaning liquid onto the atomizer during intervals between electrostatic coating of target substrates moving with respect to the electrostatic coating applicator, or to halt or interrupt coating composition deposition and change the coating composition to a coating composition having a different color.

20. An apparatus according to claim 14 wherein the fluid flow control unit is operatively coupled and configured to halt or interrupt coating composition deposition without employing organic solvent to clean the atomizer.

* * * * *